United States Patent [19]

Andersson et al.

[11] Patent Number: 4,460,137

[45] Date of Patent: Jul. 17, 1984

[54] BALLISTIC ARTILLERY PROJECTILE, THAT IS INITIALLY SPIN-STABILIZED

[76] Inventors: Kurt G. Andersson, Pudelgränd 10, S-132 62 Farsta; Gunnar E. Axelsson, Agavägen 24, S-181 38 Lidingö; Stig H. Bondesson, Olvontunet 10, S-181 48 Lidingö; Arne H. Bryngelsson, c/o Elmgard Johan Enbergsväg 9, S-171 62 Solna; Gunnar R. Flodin, Skogsvägen 50, S-122 32 Enskede; Nils E. Bartelson, Furusundsgatan 12, S-115 37 Stockholm, all of Sweden

[21] Appl. No.: 325,428

[22] PCT Filed: Mar. 30, 1981

[86] PCT No.: PCT/SE81/00100

§ 371 Date: Nov. 20, 1981

§ 102(e) Date: Nov. 20, 1981

[87] PCT Pub. No.: WO81/02926

PCT Pub. Date: Oct. 15, 1981

[30] Foreign Application Priority Data

Mar. 31, 1980 [SE] Sweden ..... 8002453

[51] Int. Cl.[3] ..... F42B 15/16

[52] U.S. Cl. ..... 244/3.27

[58] Field of Search ..... 102/348, 385, 388; 244/3.23, 3.24, 3.27

[56] References Cited

U.S. PATENT DOCUMENTS

| | | | |
|---|---|---|---|
| 1,300,708 | 4/1919 | Edison | 244/3.27 |
| 3,490,756 | 1/1970 | Spier | 267/154 |
| 3,589,645 | 6/1971 | Haglund et al. | 244/3.27 |
| 3,964,696 | 6/1976 | Orzechowski et al. | 244/3.23 |
| 4,143,838 | 3/1979 | Holladay | 244/3.28 |
| 4,158,447 | 6/1979 | Humphries et al. | 244/3.27 |
| 4,162,053 | 7/1979 | Bjornson | 244/3.27 |
| 4,296,895 | 10/1981 | Pazmany | 244/3.29 |
| 4,336,914 | 6/1982 | Thomson | 244/3.27 |

FOREIGN PATENT DOCUMENTS

| | | |
|---|---|---|
| 566204 | 4/1958 | Belgium . |
| 13096 | 12/1979 | European Pat. Off. . |
| 2402939 | 9/1974 | Fed. Rep. of Germany . |
| 2289873 | 10/1975 | France . |
| 357822 | 3/1969 | Sweden . |
| 7900802 | 3/1981 | Sweden . |
| 595605 | 2/1978 | Switzerland . |

*Primary Examiner*—Richard E. Schafer
*Assistant Examiner*—Maureen T. Ryan
*Attorney, Agent, or Firm*—Fleit, Jacobson, Cohn & Price

[57] ABSTRACT

A ballistic artillery projectile that is initially spin stabilized and is provided with fins that are extended after the projectile has covered a part of its trajectory. The fins are attached to the body of the projectile by means of bars that are non-rotatably engaged with the fins and the projectile, and that have portions between the fins and the projectile that are designed to be deformed by torsion when the fins are being extended.

7 Claims, 1 Drawing Figure

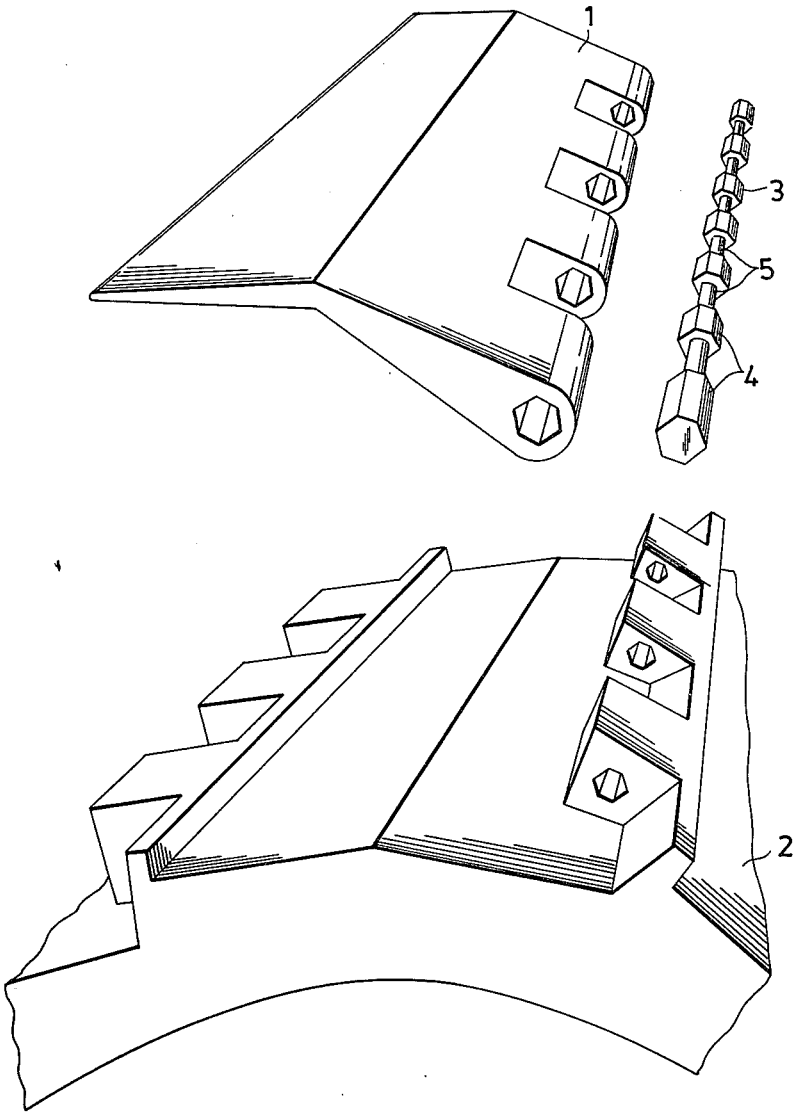
1
3
5
4
2

BALLISTIC ARTILLERY PROJECTILE, THAT IS INITIALLY SPIN-STABILIZED

The present invention relates to a ballistic artillery projectile, that is initially spin-stabilized and provided with extendable fins, designed to be extended after the projectile has covered a part of the trajectory.

The development in the artillery field, both the land and the sea artillery fields, has resulted in an increased range of fire, for example by means of so-called base bleed units. The increased range of fire is naturally desirable but it leads to increased aboslute dispersion of the projectiles. This increased dispersion is very unfavorable, all the more so as a change in the threat picture has become noticeable towards a greater frequency of smaller and harder elementary targets where each elementary target has to be combatted. In order to reduce the dispersion of the projectiles, terminal correction of terminal guidance of the projectiles has been proposed. This means that a projectile is fired in a ballistic trajectory in a conventional manner but at the end of the trajectory a targetseeking device and guidance device are activated which can lead the projectile to a hit or near hit on the target. Compared with a radical exchange of tube artillery for missiles, a system with terminally corrected projectiles is less complicated to handle and cheaper. The projectile is also less complicated than a missile because continuous guidance is not used. Moreoever, the projectile is more difficult to disturb as it follows a ballistic trajectory for a great or greater portion of the flight.

Different solutions to this problem have been introduced. Conventional artillery ammunition is spin-stabilized over the whole trajectory, that is it has a high speed of rotation (of the order of magnitude of 300–2000 rad/-sec). Solutions to the problems of terminal guidance of projectiles which are spin-stabilized over the whole trajectory have been put forward. The advantages of such a system are that a completely conventional firing can be effected with ammunition effects which differ little in size and weight from conventional ammunition. The disadvantages are the very complicated guiding and the limited range of control as well as the very uncertain possibilities of realization.

The target seeker is complicated and considerable difficulties arise in correcting the course since the roll position of the projectile must be determined when the guiding signal is given. It has been proposed that the roll direction should be determined in relation to a reference direction by means of so-called rate-gyros and integration. This proposal is not without problems, however, because gyros are sensitive to acceleration and can drift. With projectiles which are fired with a gun barrel, the sensitivity to acceleration is a particularly serious problem.

The majority of solutions hitherto put forward to the problems of terminal guidance mean that the projectile is provided with so-called rotating driving bands which means that the projectile has a low speed of rotation (of the order of magnitude 0–200 rad/sec) when it leaves the muzzle. This means that stabilizing fins must be extended immediately outside the muzzle. The advantage of this system with low or no speed of rotation in the trajectory is that target seeking and guiding can be fairly simple. In addition, certain warheads, such as explosive charges with a hollow-charge effect, require a low speed of rotation to give a good result. The disadvantages of this system are that the range of firing is adversely affected. Moreover, the dispersion easily increases since the projectile is sensitive to disturbances at the beginning of the trajectory, that is to say when the fins are extended, and the extension of the fins easily introduces disturbances. Moreover, with the solutions hitherto proposed, the length of the projectile has greatly exceeded that which applies to conventional projectiles, which imposes new demands on the handling of ammunition, particularly where automatic loading systems are concerned.

Swedish patent application 79 08002-4 relates to an invention, which combines the advantages of the abovementioned systems at the same time as the disadvantages are minimized. This is achieved by a projectile being fired from a barrel in a ballistic trajectory and at this being given a stabilizing rotation. After the projectile has covered a part of the trajectory, usually more than half, fins are extended, which brakes the rotation of the projectile and thereafter stabilizes the projectile during the rest of the trajectory.

In several other connections there is also a need to brake the rotation of rotating projectiles, e.g., before certain flare shells or the like are able to unfold a parachute, that will give a slow descent. The braking of the rotation can in these cases be done in the same way with the help of extendable fins, as in the more detailed example above.

This simple principle is, however, very difficult to realize, because the dynamic forces on the fins, which are caused by the centrifugal forces from the rotation of the shell and which are the motive power at the extension, are very large during the course of extension and at the impact of the fins against a stop and locking device in the extended position, unless special measures are taken in order to brake the course.

The mechanism of the extension of the fins must have the following qualities.

- The device must comprise a joint around which the fins can be extended. The joint must be strong enough to bear the load from the fins.
- The device should also comprise a brake that limits the extension speed of the fins. Otherwise the stresses on the construction as the fins hit the end position of the extension will exceed the possible strength of the same.
- The device must fix the fins in extended position with such a rigidity that it can take up the air forces.

The present invention means that the above-mentioned three functions are combined in one and the same machine element, a torsion bar, by giving the invention the design that is evident from the following claims.

In the following description the invention will be described in more detail with reference to the accompanying drawing, which shows an exploded view of a part of a projectile fitted with one embodiment of the invention.

The desired qualities are achieved by the fins 1 being attached to the body of the shell 2 by means of bars 3 that are designed to be able to be plasticly twisted torsion bars. The torison bars 3 are attached to the fins 1 and the projectile 2 by means of parts 4, engagement parts, designed so that rotation of the bars 3 in relation to the fins 1 and the projectile 2 is made impossible. The engagement parts 4 could be polygonal in cross section and extend through holes in the fins 1 and the projectile 2 as in the embodiment shown in the drawing. In other embodiments of the invention they could be provided with splines or attached by shrinking, with the help of a through pin or a key joint. One can also conceive of other ways of attaching the engagement parts 4 to the fins 1 and the projectile 2 which do not require that the bars 3 pass through holes in them. The engagement parts 4 could for example be welded to the fins 1 and the projectile 2. Between engagement parts 4 attached to the fins 1 and engagement parts 4 attached to the projectile 2 the bars 3 are made with torsion parts 5 designed to be deformed by torsion when the fins 1 are being extended.

The FIGURE shows a fin 1 which in retracted position on the hole follows the outer surface of the projectile 2, a so-called wrap-around fin. It is, however, also possible to use fins 1 of another common type, namely such that lies in a radial slot in the projectile 2 in the retracted position and are extended by rotation around a bar 3 that lies as a chord in the cross section of the projectile 2.

The fins 1 are mounted in retracted position and are held in this position during the initial part of the flight of the projectile 2 in the trajectory by a design detail that does not concern the invention. The locking ends after a delay device, for instance a pyrotechnic charge, has given an impulse. Owing to the centrifugal forces, and in certain embodiments air forces, the fins 1 are then extended while the torsion parts 5 of the bars 3 are being deformed by torsion. By adjusting the cross section of the torsion parts 5 the moment of deformation can be decided and by adjusting the length of the torsion parts the stress level in the bars can be put at a suitable level. Thus it is the moment of deformation that brakes the extension of the fins caused by the centrifugal forces and it is also the moment of deformation that sets the limit to the load carrying capacity of the fins in extended position. The material in the bars and the cross section and length of the torsion parts 5 decide the spring stiffness of the mount of the fins in extended position. The torision parts 5 could for instance be made by turning the bar.

Tests have shown that the bars for instance could be made of steel according to SIS (the Swedish Standards Institution) 2346. In one of these tests such a steel bar having a length of 10.5 mm and a diameter of 7.5 mm was twisted 360° before a break occured.

We claim:

1. A ballistic artillery projectile that is initially spin-stabilized and is provided with extendable fins designed to be extended after the projectile has covered a part of the trajectory, said projectile comprising:

(a) a projectile body;

(b) a plurality of fins attached to the projectile body;

(c) connecting means for pivotally attaching said fins to said body, said connecting means being non-rotatably received in each of said body and said fins and including portions plastically deformable in torsion to brake by plastic deformation the outward extension of said fins from said body caused by spin-induced centrifugal forces acting on said fins.

2. An artillery projectile according to claim 1 wherein said connecting means includes torsion bars having a plurality of spaced engagement parts, at least one per bar in fixed engagement with a fin and at least one per bar in fixed engagement with the projectile body so that rotation of the bars in relation to the fins and the projectile body is made impossible and with torsion parts positioned between engagement parts attached to the fins and engagement parts attached to the projectile body and that deform by torsion when the fins are being extended from the projectile body.

3. An artillery projectile according to claim 2, wherein the engagement parts of the torsion bar have a polygonal cross section.

4. An artillery projectile according to claim 2, wherein the engagement parts of the torsion bar have splines.

5. An artillery projectile according to one of the claims 2–4, wherein the torsion parts of the torsion bar have a predetermined cross section and length to provide moment of deformation to brake the extension of the fin and to support the fin in extended position.

6. An artillery projectile according to one of claims 1 or 2, wherein the fins are of the wrap-around type.

7. An artillery projectile according to one of claims 1 or 2, wherein the fins in retracted position lie in a radial slot in the projectile body and are extended by rotation of the fins around a bar that lies as a chord in the cross section of the projectile body.

* * * * *